US007426278B2

(12) United States Patent
Meynial

(10) Patent No.: US 7,426,278 B2
(45) Date of Patent: Sep. 16, 2008

(54) SOUND DEVICE PROVIDED WITH A GEOMETRIC AND ELECTRONIC RADIATION CONTROL

(75) Inventor: Xavier Meynial, Saint Nazaire (FR)

(73) Assignee: Active Audio, Saint Herblain (FR)

( * ) Notice: Subject to any disclaimer, the term of this patent is extended or adjusted under 35 U.S.C. 154(b) by 0 days.

(21) Appl. No.: 10/593,821

(22) PCT Filed: Mar. 11, 2005

(86) PCT No.: PCT/FR2005/000597

§ 371 (c)(1),
(2), (4) Date: Nov. 21, 2006

(87) PCT Pub. No.: WO2005/104609

PCT Pub. Date: Nov. 3, 2005

(65) Prior Publication Data

US 2007/0165876 A1 Jul. 19, 2007

(30) Foreign Application Priority Data

Mar. 25, 2004 (FR) ..... 04 03052

(51) Int. Cl.
*H04R 27/00* (2006.01)

(52) U.S. Cl. ..... 381/82; 381/89; 381/336; 381/339; 381/182

(58) Field of Classification Search ..... 381/386–387, 381/87, 337, 339, 342, 332, 335–336, 82, 381/89, 182; 181/197, 144, 147, 184, 188, 181/159, 177, 187, 171, 152, 191–192
See application file for complete search history.

(56) References Cited

U.S. PATENT DOCUMENTS 5,452,360 A 9/1995 Yamashita et al.
5,590,214 A 12/1996 Nakamura
5,781,645 A * 7/1998 Beale ..... 381/370

(Continued)

FOREIGN PATENT DOCUMENTS

EP 1 187 094 3/2002

OTHER PUBLICATIONS

Mark S. Ureda: "Wave Field Synthesis with Horn Arrays" Audio Engineering Society, Preprint No. 4144, May 14, 1996, XP002302358.

(Continued)

*Primary Examiner*—Vivian Chin
*Assistant Examiner*—Disler Paul
(74) *Attorney, Agent, or Firm*—Young & Thompson

(57) ABSTRACT

A sound device for carrying out a homogenous sound cover for a public addressed area includes an electroacoustic source network (1), wherein each electroacoustic source (1) diffuses a version delayed by a delay (3), filtered by a filter (4) and amplified by the device input signal amplifier (5). The network is substantially rectilinear and vertical, angles θ which are formed by the emitting axes of the electroacoustic sources (1) and a normal to the network are selected such that $\theta_n > \theta_{n-1}$, wherein n is the index of the electroacoustic sources (1) numbered in ascending order from the top of the device to the bottom thereof and the delays (3) interact with the angles θ in such a way that the device generates a wavefront (6) whose shape corresponds to the desired sound cover of the public addressed area.

10 Claims, 6 Drawing Sheets

U.S. PATENT DOCUMENTS

| | | | | |
|---|---|---|---|---|
| 6,128,395 | A * | 10/2000 | De Vries | 381/387 |
| 6,628,796 | B2 * | 9/2003 | Adamson | 381/342 |
| 7,027,605 | B2 * | 4/2006 | Werner | 381/99 |
| 2004/0240697 | A1 * | 12/2004 | Keele | 381/336 |

OTHER PUBLICATIONS

Evert W. Start: "Application of Curved Arrays in Wave Field Synthesis" Audio Engineering Society, Preprint No. 4143, May 14, 1996, XP002302359.

* cited by examiner

SOUND DEVICE PROVIDED WITH A GEOMETRIC AND ELECTRONIC RADIATION CONTROL

BACKGROUND OF THE INVENTION

Field of the Invention

The system that is the object of this invention relates to wiring acoustically reverberant locations with sound. To obtain good clarity of sound and good voice intelligibility in these locations, the speakers must radiate directionally toward the listeners, in order that the direct sound perceived by the listeners (sound propagating directly from the speaker to the listeners) be of significant energy with respect to that of the sound reaching it after reverberation through the walls of the location. The public address system must, moreover, ensure sound coverage of the zone to be addressed that is as uniform as possible. Since the listeners are generally located on a horizontal plane of significant surface area, a column-type speaker should be considered with directionality that is pronounced in the vertical plane and less pronounced in the horizontal plane.

DESCRIPTION OF THE RELATED ART

Prior Art

FIG. 1 describes a typical configuration. The speaker (11) must produce a sound level that is as uniform as possible over an entire zone (12) in which the audience is located and on a frequency band that is as wide as possible. Moreover, as we have seen, it must minimize the sound energy that is radiated everywhere but toward the audience in order to minimize the energy reverberated by the location and reaching the listeners.

Two types of approaches have been developed to achieve this objective: networks that are geometrically controlled, and networks that are electronically controlled.

The Geometrically-Controlled Network

Knowing the objective of sound coverage, the shape of the acoustic wave front that the speaker must radiate can be deduced. Patents FR 2626886 and those derived from it describe a system that allows generation of a wave front that is close to this objective. The principle uses a cylindrical waveguide excited on one of its ends by a loudspeaker, and radiating through an elongated rectangular opening on the other end. The shape of the waveguide is such that the radiated acoustic field resembles that radiated by a rectangular piston of elongated shape. By superposing several of these waveguides, and tilting some relative to others, the shape of the desired wave front can be approached, and thus it is possible to approach the desired objective of sound coverage. FIG. 2 illustrates this principle with superposition of eight waveguides (22), such as the one described in Patent FR 2626886, which are linked to eight loudspeakers (21), generating a wave front (23). Patent FR 2813986 and those patents derived from it describe another waveguide allowing the same objective to be achieved.

This principle of geometrical synthesis of the wave front inevitably leads to a curved shape of the speaker, however. It is thus difficult to apply if the speaker is intended to be mounted vertically, for example on a wall or a pillar.

Patent U.S. Pat. No. 5,590,214 entitled "Vertical Array Type Speaker" presents a system composed of two columns of loudspeakers mounted facing one another, radiating through a vertical slit. This system, however, is not designed to generate a wave front ensuring uniform sound coverage.

The Electronically-Controlled Array

To generate the desired wave front, a network, i.e., array, of traditional loudspeakers and classic filtering techniques obtained from radars can also be used. FIG. 3 illustrates the principle of using delays (31), labeled $R_n$ in the figure, linked to loudspeakers (34) via filters (32) and power amplifiers (33) to approach the desired wave front (35). Thus, for example, a linear and regular network of loudspeakers spaced at an indicated distance has generated a wave front oriented along the direction $\phi$ when the following is chosen: $R_n = (n-1).\ a/c/\sin(\phi)$, c being the speed of sound, n being the loudspeaker index. Suitable use of filters (32) allows minimization of frequency variations of the structure of the radiated acoustic field. Patent WO 03034780 describes a system of this type. Unfortunately, the fact of using a limited number of loudspeakers (a network that is discrete and not continuous) induces secondary lobes of major amplitude that degrade the acoustic quality. These secondary lobes are of amplitudes that are all the greater provided that the direction of the main lobe deviates from the normal to the network.

Patent EP0791279 and those patents linked to it present a system of this type and claim a principle of positioning loudspeakers that are spaced regularly on a portion of the speaker, then logarithmically spaced. This principle makes it possible to limit the number of loudspeakers necessary, but leads to an unequal power distribution on all of the loudspeakers, and thus to a maximum radiated sound level that is less significant than if the power were equally distributed on all the loudspeakers, as is the case in the geometrical networks.

The electronically-controlled network has the advantage of being able to control to a certain degree the structure of the radiated field without mechanical modification of the system by acting simply on the filtering parameters. Conversely, it has the disadvantage of generating secondary lobes of high amplitude at high frequency, i.e., when the wavelength is less than or equal to the distance separating the loudspeakers (spatial sampling criterion).

The so-called WFS ("Wave Field Synthesis") technique also implements a network of loudspeakers that is electronically controlled by delays, filters and power amplifiers. By application of the Huygens principle, suitable control of delays and filters makes it possible to generate a wave front corresponding to a virtual source located at a given location in space. This is then called "spatialization." By extension, this technique has been used to record and reproduce sound, as well as in acoustics of rooms to simulate in a room or in the outdoors the acoustics of another room (see, for example, Patents EP0335468, U.S. Pat. No. 5,452,360 and the like). Curved networks of loudspeakers have been implemented within the framework of WFS (see the article of Evert W. Start "Application of Curved Arrays in Wave Field Synthesis," Preprint No. 4143, 100th AES Convention, 1996). Patent EP12099498 and those patents linked to it describe an implementation of WFS with a particular type of loudspeaker. The article of Mark S. Ureda "Wave Field Synthesis with Horn Arrays" (Preprint No. 4144, 100th AES Convention, Copenhagen, May 1996) describes the implementation of the WFS with horn loudspeakers.

In all of these works, the objective is to be able to generate wave fronts of varied shape, and the orientations of the loudspeaker emission axes are perpendicular to the network. The network radiation is controlled exclusively by the electronic parameters (essentially delays and filters) and not by changing the orientations of the loudspeakers, as is the case for the geometrically-controlled networks that we have discussed.

SUMMARY OF THE INVENTION

The advantage of the system that is the object of this invention is to combine the advantages of a geometrical network with those of an electronically controlled network; it allows outstanding control of the radiated acoustic field, minimizing the secondary lobes, optimizing the maximum emissible power by a uniform distribution on all of the loudspeakers, while having a rectilinear shape allowing easy integration, for example as applied to a wall.

To do this, the object of the invention is a public address system allowing uniform sound coverage of a zone to be addressed, comprising a network of electroacoustic sources, each electroacoustic source diffusing a version delayed by a delay, filtered by a filter, and amplified by an input signal amplifier of the system, characterized in that said network is essentially rectilinear and vertical, in that the angles θ formed by the axes of emission of the electroacoustic sources and the normal line to the network are such that $\theta_N>\theta_{n-1}$, where n is the index of the electroacoustic sources numbered in increasing order from top to bottom of the system, and in that the delays work with the angles θ such that the device generates a wave front of the shape corresponding to the desired sound coverage of the zone to be addressed.

Preferably, the angles of inclination θ of the electroacoustic sources are chosen such that for each of the electroacoustic sources, the distance d separating the center of said electroacoustic source from the point of intersection between the axis of emission of said electroacoustic source and the desired wave front is minimal. The delays are essentially $R_n=R_{n-1}+(d_{n-1}-d_n)/c$ for n>1, $R_n$ being the delay (in seconds) linked to the nth electroacoustic source, $R_1$ being any value, c being the speed of sound in m/s, the distances d being expressed in meters.

In the case where the electroacoustic sources are all of the same height, the definition of the delays given above corresponds essentially to $R_n=R_{n-1}+a_{n-1}/c.\sin((\theta_n+\theta_{n-1})/2$ for n>1, $R_1$ being any value, $a_n$ being the distance (in meters) separating the center of the nth electroacoustic source from the center of the (n+1)th, and the angles θ being expressed in radians.

BRIEF DESCRIPTION OF THE DRAWINGS FIGURES

The invention will be well understood by reading the following description of embodiments, with reference to the attached drawings in which.

DETAILED DESCRIPTION

Figure 1:
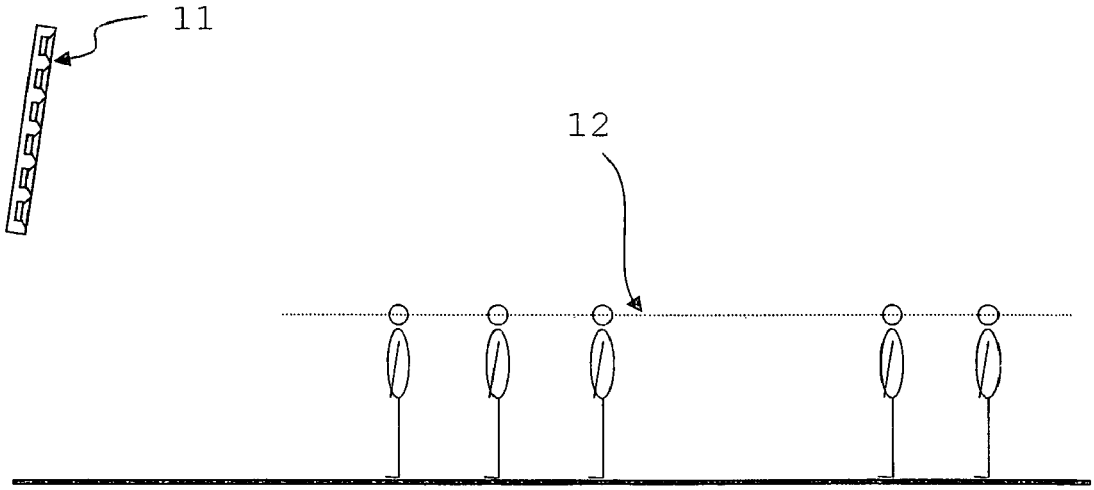
FIG. 1 shows a traditional public address configuration.
Figure 2:
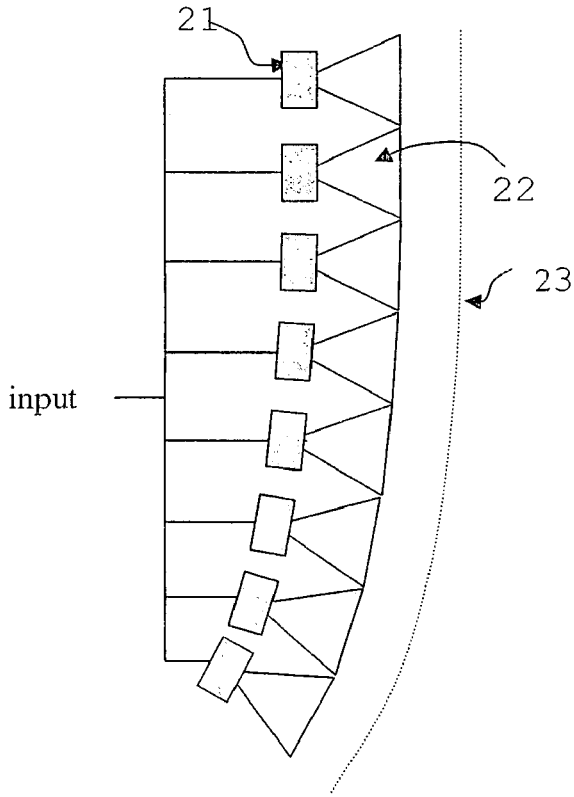
FIG. 2 shows the principle of a geometrically controlled network according to the prior art.
Figure 3:
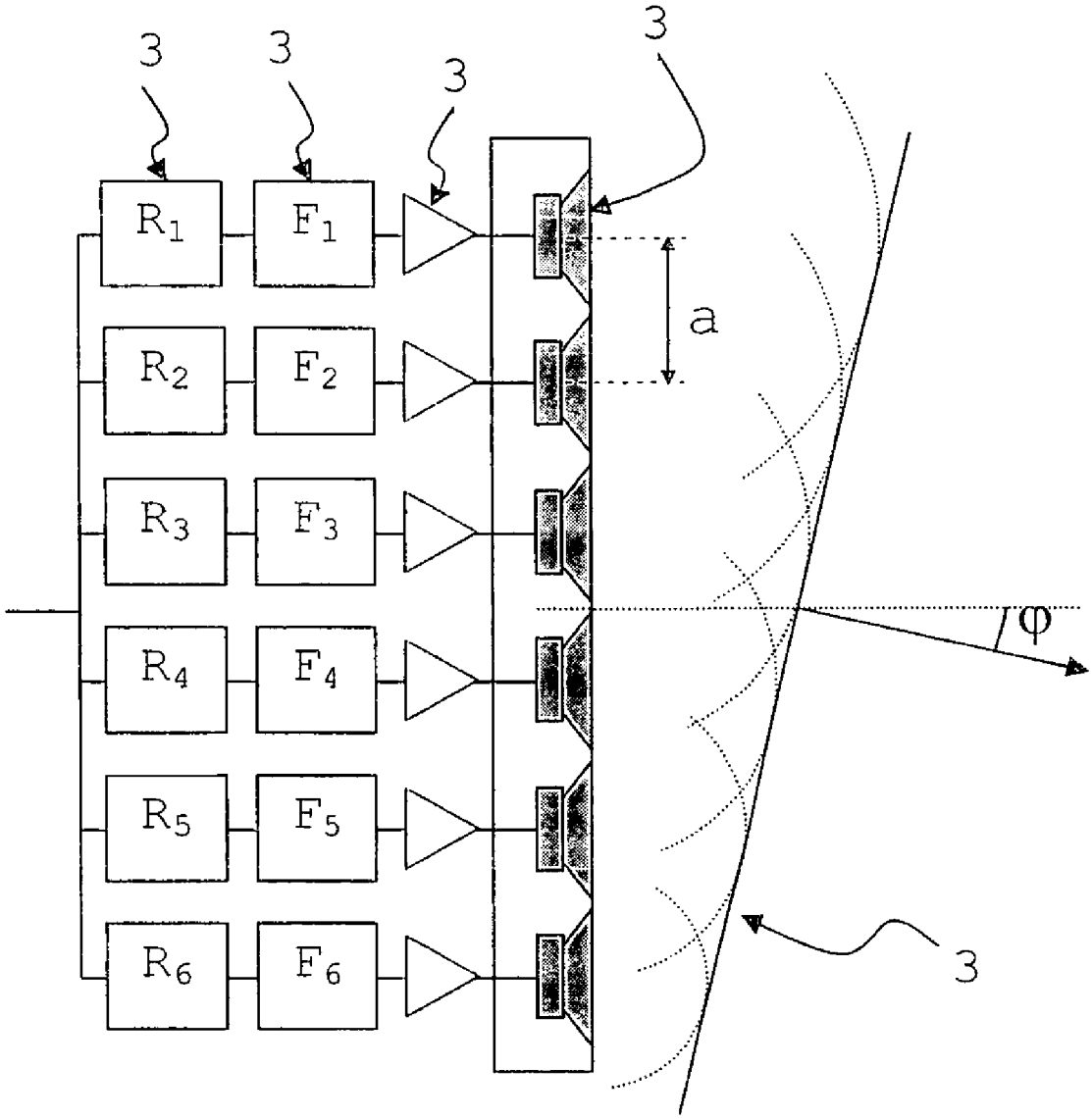
FIG. 3 shows the principle of an electronically-controlled network according to the prior art.
Figure 4:
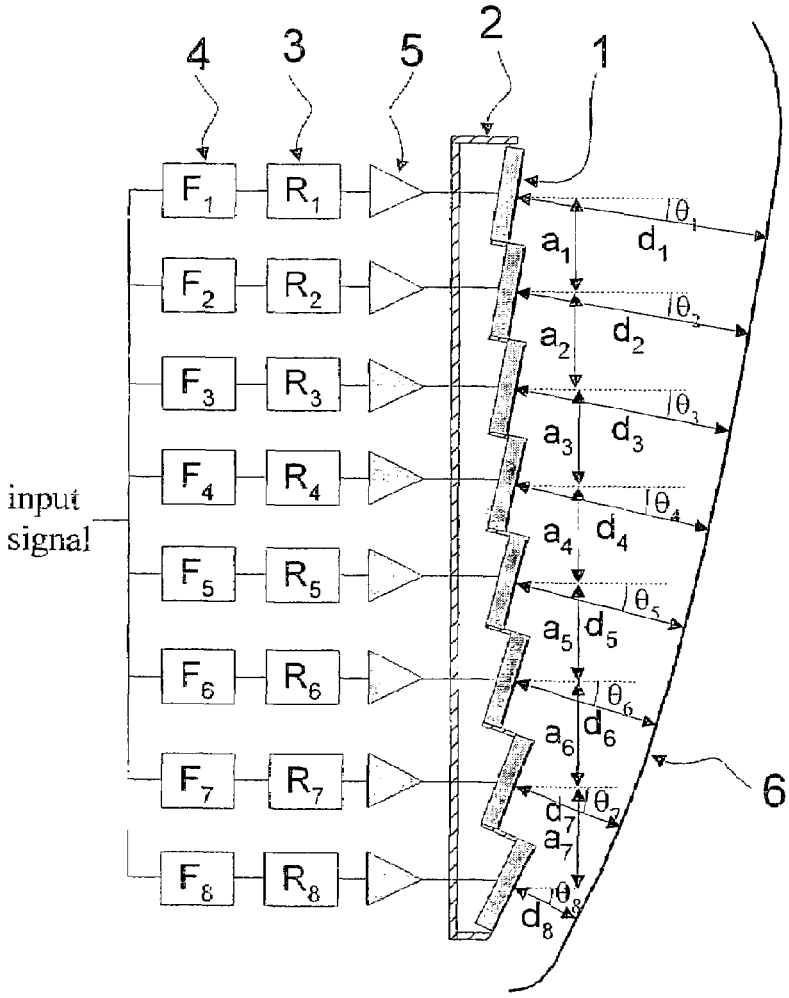
FIG. 4 shows the principle of the invention, viewed in a longitudinal section.

The principle of the invention, shown in FIG. 4 in a longitudinal section for the case of eight electroacoustic sources, is inspired by the Fresnel lenses used in optics. A network of N electroacoustic sources (1) is linked to delays (3), filters (4) and power amplifiers (5). The electroacoustic sources (1) are vertically aligned and oriented such that, combined with a set of delays (3) selected in an appropriate manner, they generate the wave front (6) of the desired shape, corresponding to a desired sound coverage on the zone to be addressed. The filters and delays can, of course, be switched around, and other components (limiters, for example) can be inserted upstream from the power amplifiers. The input signal to be diffused is applied to all of the electroacoustic sources via the delays (3), filters (4) and amplifiers (5).

The originality of this invention thus consists in generating the desired wave front (6) by acting at the same time on the geometric aspect by means of the orientations and positioning of the electroacoustic sources (1) of the network, and on an electronic aspect by compensating for the spatial intervals between the electroacoustic sources (1) especially by delays (3).

With reference to FIG. 4, the angle of inclination $\theta_a$ of the nth electroacoustic source is such that the distance $d_n$ separating the center of said electroacoustic source from the point of intersection between the axis of emission of said electroacoustic source and the desired wave front is minimal for all of the electroacoustic sources.

Since the electroacoustic sources (1) are numbered from top to bottom, the delay $R_n$ linked to the nth electroacoustic source must then be $R_n=R_{n-1}+(d_{n-1}-d_n)/c$ for n=2 at N, c being the speed of sound (in m/s) and N being the number of electroacoustic sources ($R_n$ in seconds, $d_n$ in meters). It is possible to take $R_1=0$ or any other value. It should be noted that these are the differences $d_{n-1}-d$, that arise, and thus that the definition above does not depend on the wave front propagation.

The height of an electroacoustic source (1) is called the distance separating the bottom end from the top end of said source. According to the principle described above, and in the case in which the electroacoustic sources are all of the same height, the values of the delays (3) can again be expressed as a function of the angles of inclination θ (in radians) of the electroacoustic sources (1) according to the formula $R_n=R_{-1}+(a_{n-1}/c)\sin(\theta_n+\theta_{n-1})/2)$ for n=2 at N, $R_n$ being the delay (in seconds) linked to the nth electroacoustic source, $R_1$ being any value, $a_n$ being the distance (in meters) separating the center of the nth electroacoustic source from the center of the (n+1)th, and c again being the speed of sound (in m/s).

In the conventional situation in which the system is placed above the zone to be addressed, this principle leads to a set of angles θ such that $\theta_n>\theta_{n-1}$. Thus, a set of angles θ and of values of the delays (3) corresponds to one shape of the wave front (6) and one given type of electroacoustic source. However, by assigning to the delays (3) values that are slightly different from those resulting from the formulas given above, and by optionally acting on the gains and frequency responses of filters (4), it is possible to generate a wave front that is different from the one corresponding to the set of angles θ. This allows for, for example, partial correction of the effect of a positioning of the column at a height different from that for which it was designed (angles of inclination θ) or else for correction of an unsuitable sound level in a certain zone resulting from an acoustic phenomenon of the location under consideration.

If the electroacoustic sources are not all identical, then the filters (4) will also be used to correct the differences that can exist between their frequency and/or time response characteristics.

The filters (4) and delays (3) can be implemented by a digital signal processor (DSP) provided with suitable software.

The length of the network, i.e., array, is a major parameter of the invention, as for all other types of networks, i.e., arrays. The larger it is, the larger the zone that the network allows to be covered and the better the uniformity of the coverage at low frequencies.

Figure 5:
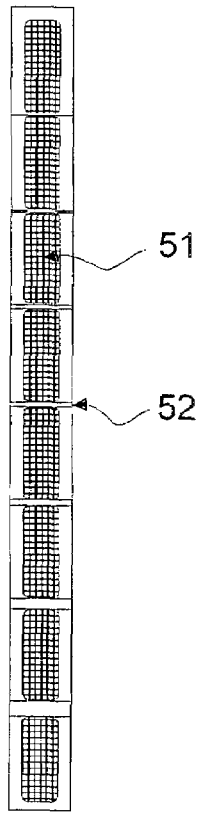
FIG. 5 shows a front view of the loudspeaker network mounted in a speaker.
Figure 6:
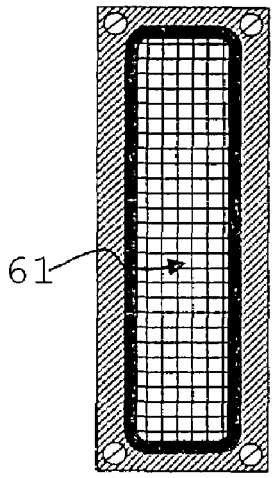
FIG. 6 shows a front view of a loudspeaker with an essentially rectangular membrane.

In a first embodiment of the invention, the electroacoustic sources (1) are direct radiation loudspeakers, these loudspeakers being preferably equipped with essentially rectangular membranes. The optimum performances in terms of secondary lobe rejection are obtained when each loudspeaker emits in the manner of a rectangular piston that is as high as the gaps between the loudspeakers allow. FIG. 5 shows a front view of the network of loudspeakers (51) mounted in a speaker (52), with radiating surfaces that are preferably essentially rectangular, possibly slightly curved in the vertical plane to better follow the shape of the wave front to be restored. FIG. 6 shows a loudspeaker with a membrane (61) that is essentially rectangular, seen from the front.

In a second embodiment of the invention, the electroacoustic sources (1) are loudspeakers radiating through waveguides. Each waveguide radiates through an essentially rectangular orifice such that the particular acoustic velocity is at any instant essentially the same at any point of the radiation opening. Actually, the optimum performance levels in terms of secondary lobe rejection are obtained when the waveguides radiate through a rectangular opening as would be done by a rectangular piston (for example those described in Patents FR 2626886 and FR 2813986 that have already been mentioned), and their height is as great as allowed by the space between the waveguides.

Figure 7:
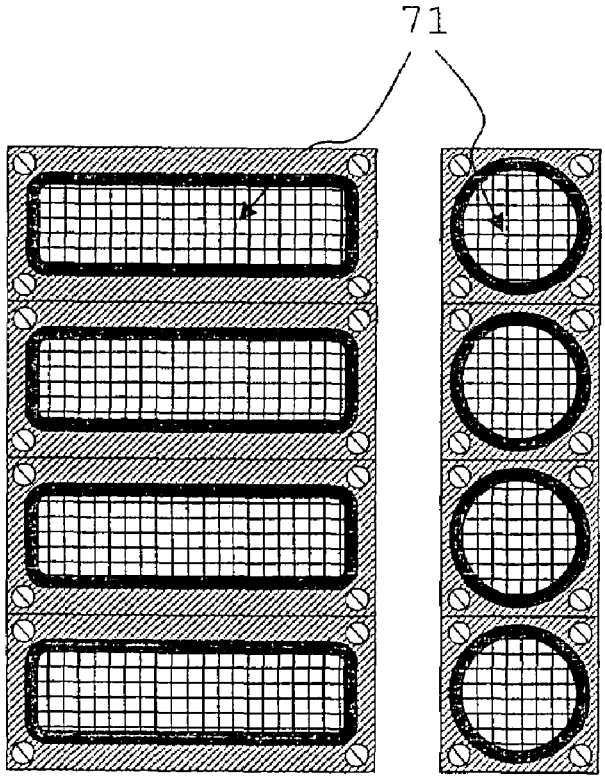
FIG. 7 shows, in the form of front views, the combination of loudspeakers with rectangular and circular membranes.
Figure 8:
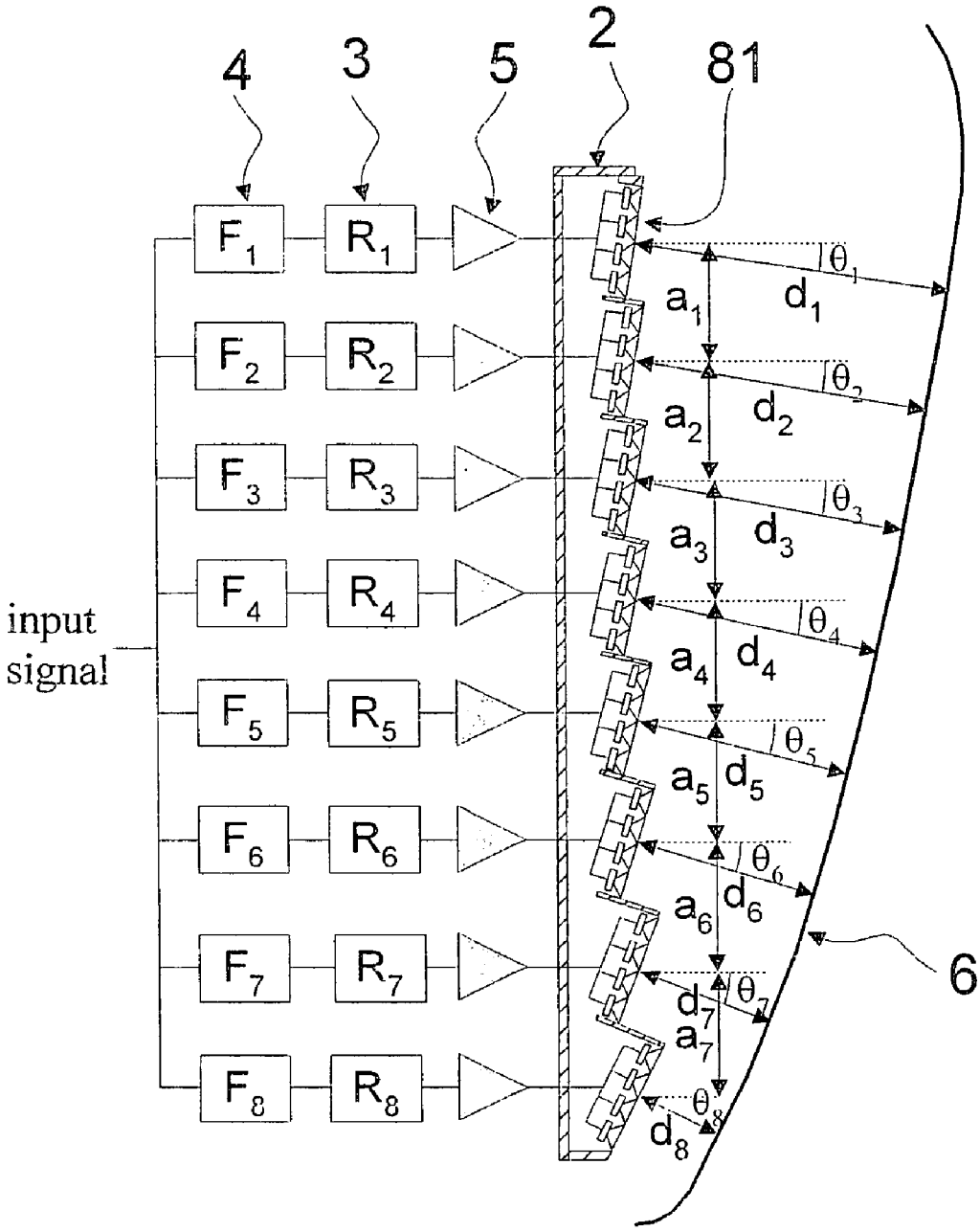
FIG. 8 shows an embodiment of the invention viewed in a longitudinal section, in which the electroacoustic sources are composed of groups of loudspeakers.

In a third embodiment of the invention, the electroacoustic sources (1) are groups of loudspeakers, all the loudspeakers of the same group being located in the same plane, arranged side by side and excited by the same electrical signal. The loudspeakers of the same group are thus combined such that the group radiates essentially as a rectangular piston would in the frequency band under consideration. Actually, for frequencies corresponding to lower wavelengths at the distance between adjacent loudspeakers, the radiation of a regular combination of small loudspeakers in one loudspeaker group is close to the radiation of a piston that is of the size of the combination. FIG. 7 provides two examples of a combination of loudspeakers into a group of loudspeakers for loudspeakers with a rectangular and circular membrane (71) viewed from the front on the side of the membranes. FIG. 8 illustrates this embodiment of the invention in the case of eight groups of 4 loudspeakers. This figure is identical to FIG. 4, except that the electroacoustic sources (1) have been replaced by groups of loudspeakers (81).

Figure 9:
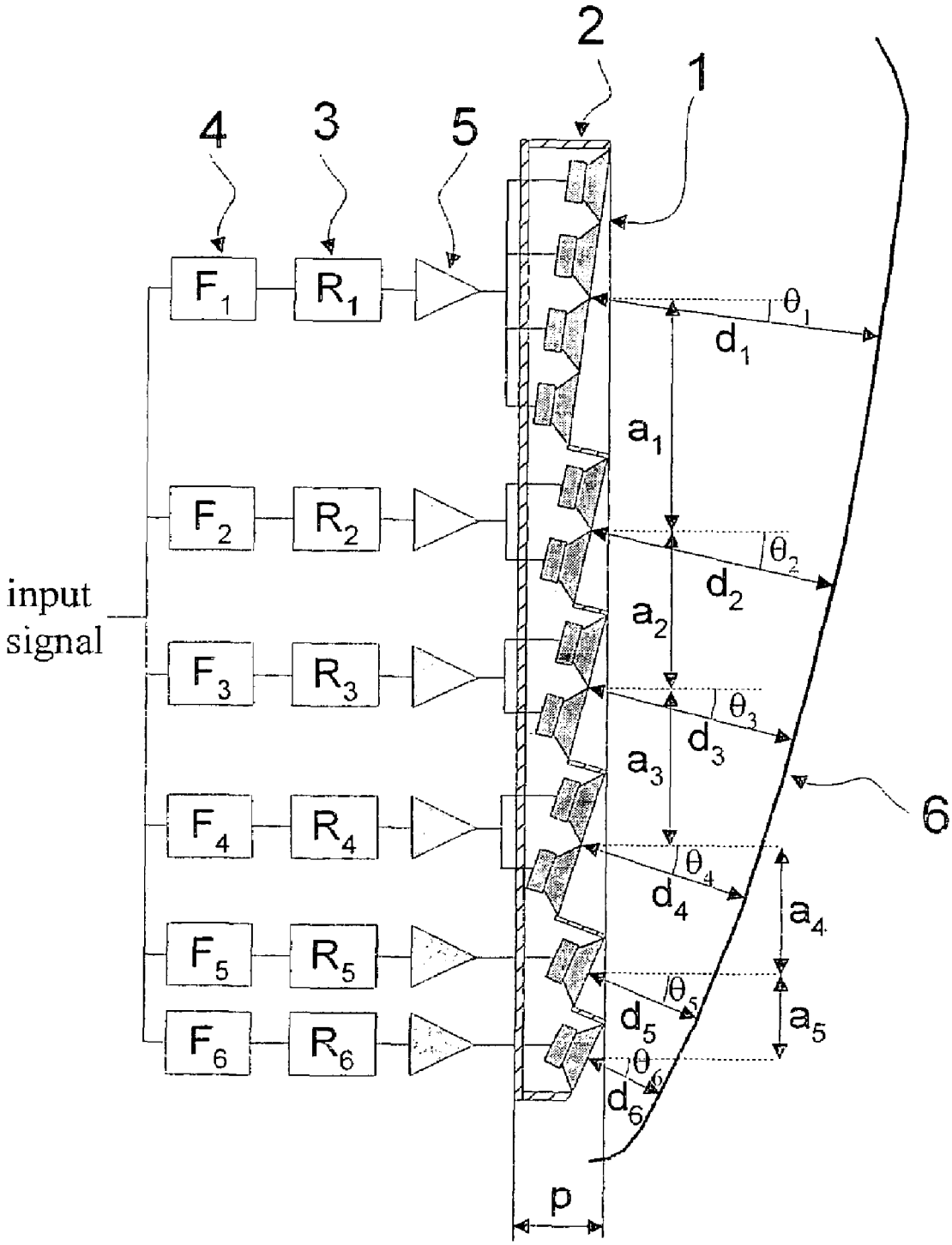
FIG. 9 shows one embodiment of the invention viewed in a longitudinal section, in which the electroacoustic sources are of different heights.

In another embodiment of the invention, the electroacoustic sources (1) are of different heights, the height of each source being essentially a function of the associated angle θ: the smaller it is, the greater the height of the source. This is illustrated by FIG. 9 in which the indices (1), (2), (3), (4), (5), and (6) have the same meanings as in FIG. 4. This embodiment has the advantage of minimizing the depth of the column, denoted p in FIG. 9. The delays (3) are again essentially $R_n=R_{n-1}+(d_{n-1}-d_n)/c$ for n>1, $R_n$ being the delay (in seconds) linked to the nth electroacoustic source, $R_1$ being any value, c being the speed of sound in m/s, the distances d being expressed in meters.

The electroacoustic sources (1) can be mounted or fixed on the same speaker (2). The rear surfaces of the membranes of the electroacoustic sources (1) can then either each radiate in an independent volume resulting from the partitioning of the speaker (2), or can all radiate in the same volume. In fact, for the frequencies beyond the resonant frequency of the loudspeakers, they are essentially controlled by their movable mass, and not by the stiffness of the volume of air that charges them at the rear.

In another embodiment of the invention, each electroacoustic source (1) is mounted on a speaker that is particular to it, and the speakers are combined according to the principle of positioning and orientation described above using a mechanical system. In other words, the electroacoustic sources (1) are attached to speakers that are mechanically connected to one another. This embodiment makes it possible to optimally adjust the orientations of the electroacoustic sources (1) for a given positioning of the system and a desired sound coverage.

The delays (3) and filters (4) can be implemented by a digital signal processor (DSP) provided with suitable software.

The delays (3), filters (4) and amplifiers (5) can be mounted in the speaker (2) or can remain outside of the speaker.

The invention claimed is:

1. A public address system allowing uniform sound coverage over a zone to be addressed, comprising:

an array of electroacoustic sources (1), each electroacoustic source (1) diffusing a version delayed by a delay (3), filtered by a filter (4), and amplified by an input signal amplifier (5) of the system, wherein said array is essentially rectilinear and vertical, in that the angles θ formed by the axes of emission of the electroacoustic sources (1) and the normal line to the array are such that $\theta_n > \theta_{n-1}$, where n is the index of the electroacoustic sources (1) numbered in increasing order from top to bottom of the system, and in that the delays (3) work with the angles θ such that the system generates a wave front (6) of the shape corresponding to the desired sound coverage of the zone to be addressed, wherein the angles of inclination θ of the electroacoustic sources (1) are chosen such that for each of the electroacoustic sources (1), the distance d separating the center of said electroacoustic source from the point of intersection between the axis of emission of said electroacoustic source and the desired wave front is minimal, and wherein the delays (3) are essentially $R_n=R_{n-1}+(d_{n-1}-d_n)/c$ for n>1, $R_n$ being the delay in seconds linked to the nth electroacoustic source, $R_1$ being any value, c being the speed of sound in m/s, the distances d being expressed in meters.

2. The system according to claim 1, wherein the electroacoustic sources (1) are direct radiation loudspeakers.

3. The system according to claim 2, wherein the loudspeakers are equipped with essentially rectangular membranes.

4. The system according to claim 1, wherein the electroacoustic sources (1) are loudspeakers radiating through waveguides.

5. The system according to claim 4, wherein each waveguide radiates through an essentially rectangular orifice such that the particular acoustic velocity is at any instant essentially the same at any point of the radiation orifice.

6. The system according to claim 1, wherein the electroacoustic sources (1) are groups of loudspeakers.

7. The system according to claim 6, wherein the loudspeakers of the same group are adjacent, located in the same plane, and combined such that the group radiates essentially as a rectangular piston would in the frequency band under consideration.

8. The system according to claim 1, wherein the electroacoustic sources (1) are fixed on the same speaker (2).

9. The system according to claim 1, wherein the electroacoustic sources (1) are attached to speakers that are mechanically connected to one another.

10. The system according to claim 1, wherein the electroacoustic sources (1) are of different heights.

* * * * *